US006007379A

United States Patent [19]

Michaelis et al.

[11] Patent Number: 6,007,379

[45] Date of Patent: Dec. 28, 1999

[54] ELECTRICAL CONNECTOR ASSEMBLY

[75] Inventors: Daniel K. Michaelis, Cordova; David T. Humphrey, Collierville, both of Tenn.

[73] Assignee: Thomas & Betts International, Inc., Sparks, Nev.

[21] Appl. No.: 08/916,075

[22] Filed: Aug. 21, 1997

Related U.S. Application Data

[63] Continuation of application No. 08/798,323, Feb. 10, 1997.

[51] Int. Cl.[6] ..... H01R 13/648

[52] U.S. Cl. ..... 439/607

[58] Field of Search ..... 439/607, 608, 439/609, 610, 108, 101

[56] References Cited

U.S. PATENT DOCUMENTS

| | | | |
|---|---|---|---|
| 4,878,858 | 11/1989 | Dechelette . | |
| 4,913,664 | 4/1990 | Dixon et al. . | |
| 5,017,156 | 5/1991 | Sugiyama . | |
| 5,017,158 | 5/1991 | Liu et al. | 439/609 |
| 5,037,330 | 8/1991 | Fulponi et al. . | |
| 5,073,130 | 12/1991 | Nakamura . | |
| 5,207,597 | 5/1993 | Kline et al. | 439/607 |
| 5,256,086 | 10/1993 | Ponn . | |
| 5,266,038 | 11/1993 | Nakamura . | |
| 5,267,868 | 12/1993 | Wolff, Jr. . | |
| 5,273,459 | 12/1993 | Davis . | |
| 5,281,169 | 1/1994 | Kiat et al. . | |
| 5,288,248 | 2/1994 | Chen . | |
| 5,338,215 | 8/1994 | Lee et al. . | |
| 5,338,227 | 8/1994 | Nakamura . | |
| 5,378,172 | 1/1995 | Roberts . | |
| 5,397,250 | 3/1995 | Briones . | |
| 5,456,618 | 10/1995 | Nakamura . | |
| 5,755,595 | 5/1998 | Davis et al. | 439/609 |

FOREIGN PATENT DOCUMENTS

| | | |
|---|---|---|
| 0 430 105 | 6/1991 | European Pat. Off. . |
| 2 257 577 | 1/1993 | United Kingdom . |

*Primary Examiner*—Neil Abrams
*Assistant Examiner*—Javaid Nasri
*Attorney, Agent, or Firm*—Hoffmann & Baron, LLP

[57] ABSTRACT

An electrical connector assembly includes an insulative housing having an interconnection end, an opposed contact receiving end and at least one contact member supported within the housing. The contact member is insertably positioned in the housing through said contact receiving end. The electrical connector assembly further includes a conductive shield which is positioned in partial circumscribing relation about the housing. The shield includes at least one cooperating interlocking engagement members located on the insulative housing and shield to positively latch the shield to the housing. The positively latched shield prevents the shield from lifting off the housing during interconnection and disconnection with the mating connector and provides greater alignment of the shield with respect to the housing. The shield is preferably a one-piece construction thus providing enhanced EMI shield protection.

14 Claims, 6 Drawing Sheets

ELECTRICAL CONNECTOR ASSEMBLY

This application is a continuation of copending application Ser. No. 08/798,323, filed on Feb. 10, 1997.

BACKGROUND OF THE INVENTION

1. Field of the Invention

The present invention relates to electrical connectors, and more particularly relates to an electrical connector having a conductive shield positively latched to an insulative housing.

2. Description of the Prior Art

Electrical connectors having an insulative housing for supporting a plurality of contacts and a conductive shield surrounding the housing are currently being used on all universal serial bus (USB) connector receptacles. However, manufacturers of these receptacles have encountered difficulty in positively latching the conductive shield to the insulative housing.

For example, one currently available USB receptacle includes an insulative housing substantially surrounded by a conductive shield. The conductive shield consists of two separate pieces which are latched together to form the outer shield. This connector receptacle construction suffers from the shield lifting off the housing during interconnection and disconnection with a mating plug and poor shield electrical continuity.

Likewise, another currently available USB receptacle suffers similar disadvantages. The shield and housing are easily separated and the shield tends to lift off the housing during interconnection and disconnection with a mating plug. Movement between the shield and housing also causes alignment problems with respect to the contacts supported by the housing and the conductive shield.

Accordingly, it would be beneficial to design an electrical connector assembly including an insulative housing and a conductive shield substantially surrounding the housing which is positively locked to the housing. Thus, separation and misalignment of the housing and shield could be avoided.

OBJECTS AND SUMMARY OF THE INVENTION

It is an object of the present invention to provide an electrical connector assembly including an insulative housing and a conductive shield surrounding the housing, the shield being positively latched to the housing.

It is another object of the present invention to provide an electrical connector assembly which provides enhanced electromagnetic induction (EMI) shield coverage of the contacts supported in the connector assembly.

It is a further object of the present invention to provide an electrical connector assembly which resists movement or separation of the shield from the housing upon interconnection or disconnection with a mating connector or plug.

In accordance with one form of the present invention, an electrical connector assembly includes an insulative housing having an interconnection end, an opposed contact receiving end and at least one contact member supported within the housing. The contact member is insertably positioned in the housing through said contact receiving end. A conductive shield is positioned in partial circumscribing relation about the housing. The shield includes a pair of side shield extents which overlie side surfaces of the housing and an upper shield extent overlying the upper surface of the housing. The side shield extents and housing side walls include first cooperating interlocking members for preventing relative movement between said housing and said shield along a longitudinal direction of the housing and the upper shield extent and housing upper surface include second cooperating interlocking members for preventing relative movement of the shield and the housing in the direction transverse to the longitudinal direction.

The first cooperating interlocking members preferably include at least one projection extending from the side surface of the housing which is received in a mating recessor through hole made in the side shield extent of the conductive shield. The projection preferably includes a ramped surface to facilitate insertion of the housing into the conductive shield.

The second cooperating interlocking members include the upper shield extent being formed in a pair of longitudinally separated shield portions. Each of the shield portions include an inwardly deflected cantilevered finger portion and the housing upper surface includes a finger engaging member for engagement with said shield finger portions to lockingly engage the shield to the housing. The finger engaging members may be in the form of a slot having upstanding sidewalls and the cantilevered finger portions engage the sidewalls to lockingly engage the shield to the housing. The conductive shield further includes a front face which defines an opening permitting access to the interconnection end of the housing. The front face has a pair of transversely opposed cantilevered shield contacts extending into the interconnection end of the housing for electrical engagement with a shield portion of a mating electrical connector upon interconnection therewith.

The conductive shield may further include a rear shield extent which substantially overlies the termination end of the housing. In the preferred embodiment, the conductive shield is a one-piece construction which is positively latched to the housing to form the electrical connector assembly. In order to facilitate coupling of the connector assembly to a printed circuit board, the connector assembly includes at least one leg extending downwardly from each of the side shield extents. The legs extend through mounting holes in the printed circuit board and include tabs which lockingly engage an undersurface of the printed circuit board when bent into place.

In an alternative embodiment, the electrical connector assembly conductive shield includes an upper shield extent, two side shield extents depending from the upper shield extent and a bottom shield extent. The bottom shield extent includes a pair of bottom shield portions depending from each of the side shield extents and forms a longitudinal parting line therebetween. Each bottom shield portion includes cooperating interlocking engagement means for lockingly engaging the bottom shield portions along the parting line preventing relative transverse movement or separation therebetween. Preferably, the cooperating interlocking engagement means includes a dovetail shaped tab portion extending along the parting line of one bottom shield portion and a corresponding mating dovetail shaped recess for receiving the tab on the other bottom shield portion. The tab and recess lockingly engage to prevent relative transverse movement of the bottom shield portions with respect to each other. The tab and recess are preferably staked along the parting line to lockingly engage the bottom shield portions and prevent separation therebetween.

The conductive shield further includes a plurality of cantilevered contact members on each of the upper, side and bottom shield extents. The cantilevered shield contact members electrically engage a shield portion of a mating electrical connection upon interconnection therewith. The electrical connector may further include a horizontally extending central housing portion which supports a horizontal shield extent having cantilevered contact members thereon and overlying a portion of the housing central portion.

A preferred form of the electrical connector assembly, as well as other embodiments, objects, features and advantages of this invention, will be apparent from the following detailed description of illustrative embodiments thereof, which is to be read in connection with the accompanying drawings.

DETAILED DESCRIPTION OF THE PREFERRED EMBODIMENTS

Figure 1:
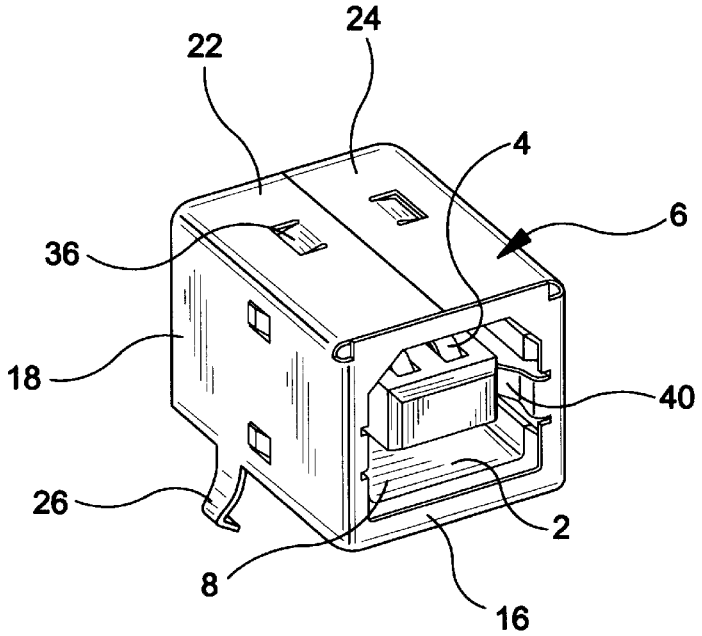
FIG. 1 is a front perspective view of a right-angle electrical connector assembly formed in accordance with the present invention.
Figure 2:
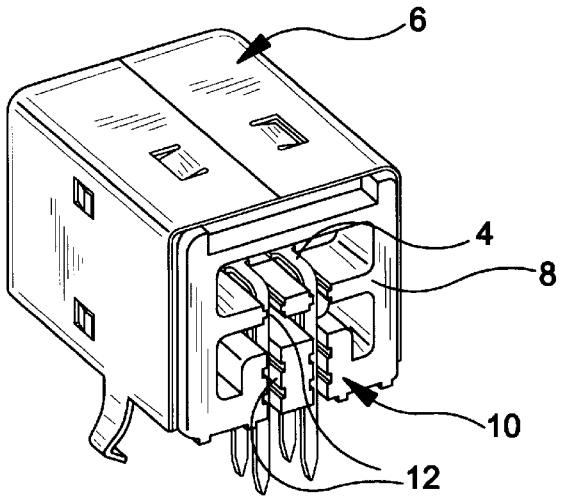
FIG. 2 is a rear perspective view of the electrical connector assembly shown in FIG. 1.

Referring to FIG. 1 of the drawings, an electrical connector assembly formed in accordance with the present invention includes an insulative housing 2 which supports a plurality of contacts 4 thereon. The electrical connector assembly further includes a conductive shield 6 which substantially covers at least three sides of the insulative housing, i.e., two opposing side surfaces and an upper surface. The electrical connector assembly illustrated in FIG. 1 is a universal serial bus (USB) series B receptacle. The receptacle includes an interconnection end 8 (FIG. 1) and an opposed contact receiving end 10 as illustrated in FIG. 2. The interconnection end is adapted to receive a mating electrical connector plug (not shown).

Figure 7:
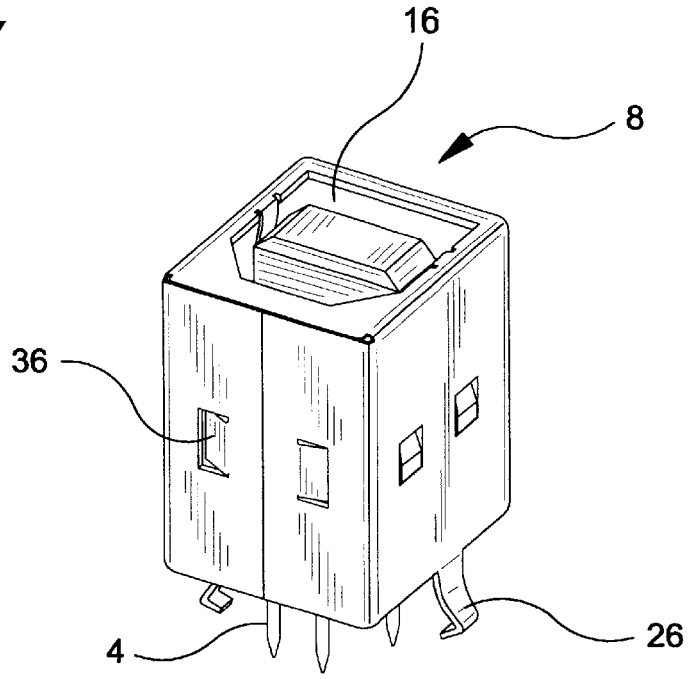
FIG. 7 is a side perspective view of a vertical electrical connector assembly formed in accordance with the present invention.

Referring to FIG. 2, the contact receiving end includes a series of contact receiving slots 12 adapted for insertably receiving the contact members of the electrical connector assembly. The contact members 4 illustrated in FIGS. 1 and 2 include an interconnection end and a termination end, the termination end being at a right angle to the interconnection end. The termination end extends beyond a bottom surface of the connector assembly for insertion into plated through holes of a printed circuit board (not shown). Alternatively, as shown in FIG. 7, each of the contact members may be substantially straight so that the connector assembly stands on an end surface or contact receiving and when coupled to a mating printed circuit board. In this configuration, the upper surface becomes a side surface and the shield circumscribes all four side surfaces of the insulative housing.

Figure 3:
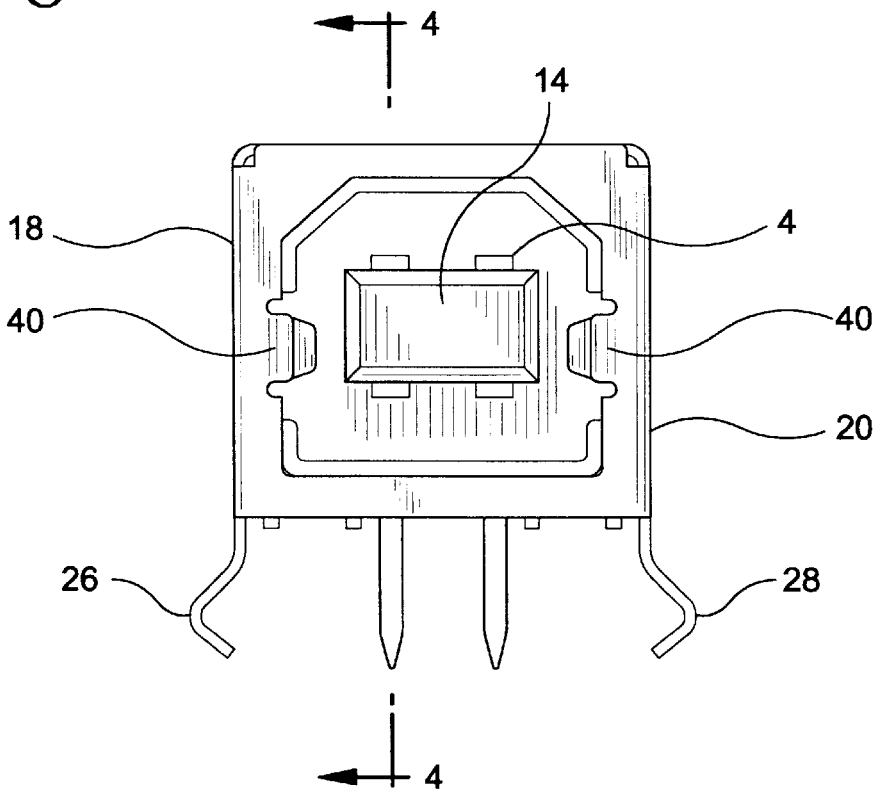
FIG. 3 is a front elevational view of the electrical connector assembly shown in FIG. 1.

Referring to FIG. 3, the electrical connector assembly formed in accordance with the present invention includes four contact members wherein a first pair of contacts is arranged in vertically stacked relation to a second pair of contacts. The contacts are made from a copper alloy having a tin/lead over nickel plating in the termination area and gold plating on the interconnection portion of the contacts. Furthermore, the contacts are generally cantilevered to be biased at the interconnection end to permit good electrical connection with mating contacts of a USB plug.

Figure 4:
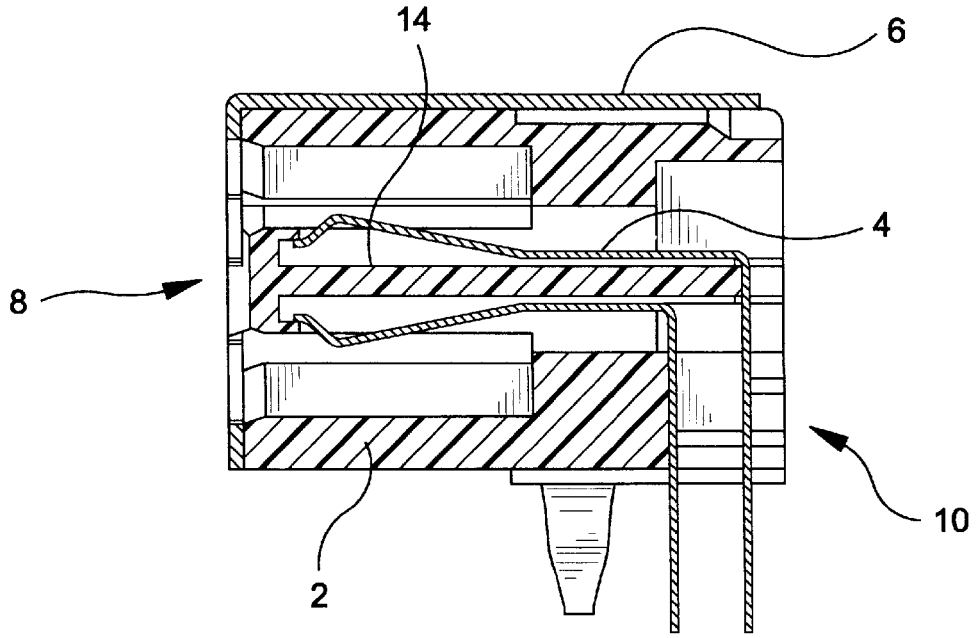
FIG. 4 is a sectional view of the electrical connector assembly taken along line 4—4 of FIG. 3.

FIG. 4 is a cross-sectional view of the connector assembly taken along line 4—4 of FIG. 3. The electrical connector assembly housing includes a central member 14 on which the contact members 4 are supported. Central housing member 14 includes a front section having a recess formed therein for receiving a bent contact extent of the contact members 4. Accordingly, the contact member 4 is biased at the interconnection end and deflectable within the housing recess upon interconnection with a mating plug.

Referring now to FIGS. 1–4, the conductive shield portion of the connector assembly will be described in more detail. Shield 6 is preferably formed from a copper alloy having a tin/lead plating and is formed in a one-piece construction which is stamped and bent to form the shield. Shield 6, illustrated in FIGS. 1–4, includes a front surface 16 having two opposed side surfaces 18, 20 depending therefrom. An upper shield extent is formed from a pair of longitudinally separated shield portions 22, 24. Each of the side shield extents 18, 20 include at least one leg 26, 28, respectively extending downwardly therefrom. The pair of legs 26, 28 are used to lockingly engage the electrical connector assembly to an upper surface of a printed circuit board. More specifically, the legs may extend through mounting holes placed in the printed circuit board and the lower extent of the leg latches onto an undersurface of the printed circuit board upon flaxing of the leg.

Figure 5:
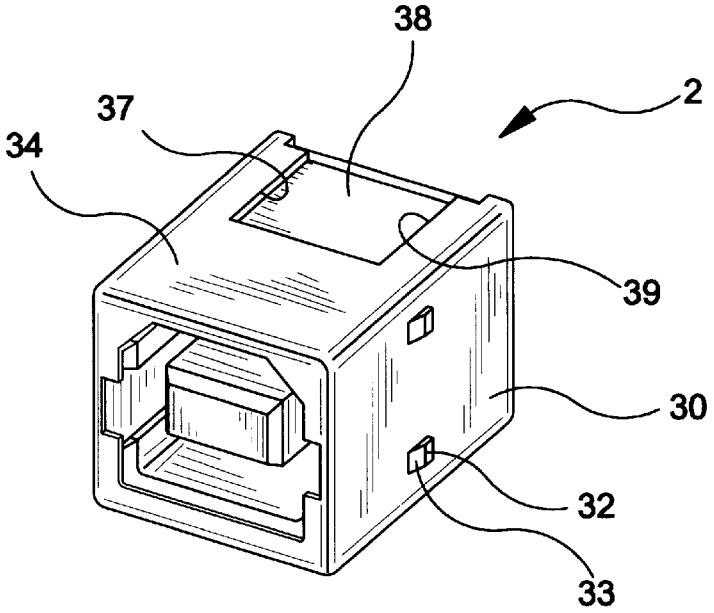
FIG. 5 is a top perspective view of the insulative housing portion of the connector assembly shown in FIG. 1.

The side shield extents 18, 20 further include cooperating interlocking members with the side surfaces 30 of the insulative housing. FIG. 5, illustrates the insulative housing of the connector assembly is shown separated from the assembly. The side surfaces 30 of the housing include at least one projection 32 extending outwardly therefrom. The projection 32 includes a ramped surface 33 to facilitate placement of the shield onto the housing. The side shield extents 18, 20 include at least one mating hole stamped therein for receiving the molded projections 32 of the insulative housing. Upon cooperating interlocking engagement of the projection in the hole formed in side shield extent, relative movement between the housing and the shield along a longitudinal direction of the housing is prevented. The preferred embodiment includes a pair of projections on each side surface of the housing and a pair of mating holes on each of the side shield extents of the conductive shield.

The electrical connector assembly illustrated in FIGS. 1–4 also includes cooperating interlocking members to lockingly engage the upper shield extent to an upper surface 34 of the housing. More specifically, the upper shield portions 22, 24 each include an inwardly deflected cantilevered finger portion 36 and the housing upper surface 34 includes a slot or recess 38 formed therein for matingly engaging the cantilevered finger portions of the upper shield extent. The slot includes upstanding side walls 37, 39 such that upon forming the conductive shield around the insulative housing, the cantilevered finger portions lockingly engage the side walls of the slot to prevent relative transverse movement of the upper shield portions 22, 24 with respect to each other. The conductive shield 6 is positively latched onto the insulative housing. Accordingly, the combination of interlocking members on the sides of the connector assembly and the orthoganally positioned interlocking members on the upper surface of the connector assembly hold the shield onto the housing and prevent lifting off of the shield during interconnection and disconnection with the mating plug.

The connector assembly of the present invention as shown in FIGS. 1 and 3 also includes a pair of shield contacts 40 for engagement with a portion of the shield of a mating electrical plug upon interconnection therewith. The shield contacts 40 are cantilevered contact members depending from the front shield extent 16 and positioned within the interconnection end of the connector assembly adjacent to the insulative housing central member 14.

Figure 6:
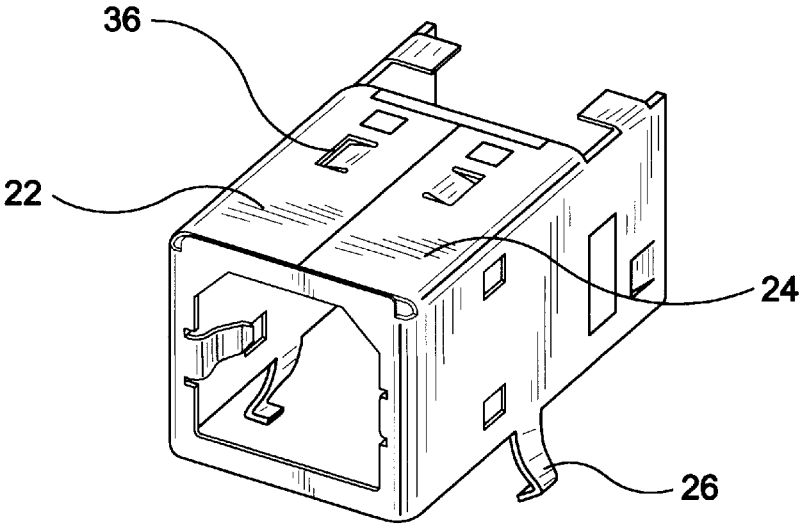
FIG. 6 is a front perspective view of a shield portion of an electrical connector assembly having a rear shield extent.

FIG. 6 is an alternative embodiment of the present invention illustrating the shield portion thereof. As illustrated in FIG. 6, the shield includes a pair of end shield extents which, after insertion of the insulative housing into the shield, may be bent to form a conductive shield around the termination end of the connector. The end shield extents lockingly engage to substantially shield the contact receiving end of the electrical connector assembly.

A further alternative embodiment of an electrical connector assembly formed in accordance with the present invention is illustrated in FIGS. 8–11. More specifically, FIGS. 8–11 illustrate a USB series A, stacked right-angle receptacle. The electrical connector assembly includes an insulative housing 80 which supports a plurality of contact members 82 thereon. The insulative housing includes an interconnection end 84 and an opposed contact receiving end 86. Similar to the previous embodiment, the connector assembly includes a conductive shield 88 positioned in partial circumscribing relation about the housing.

Figure 9:
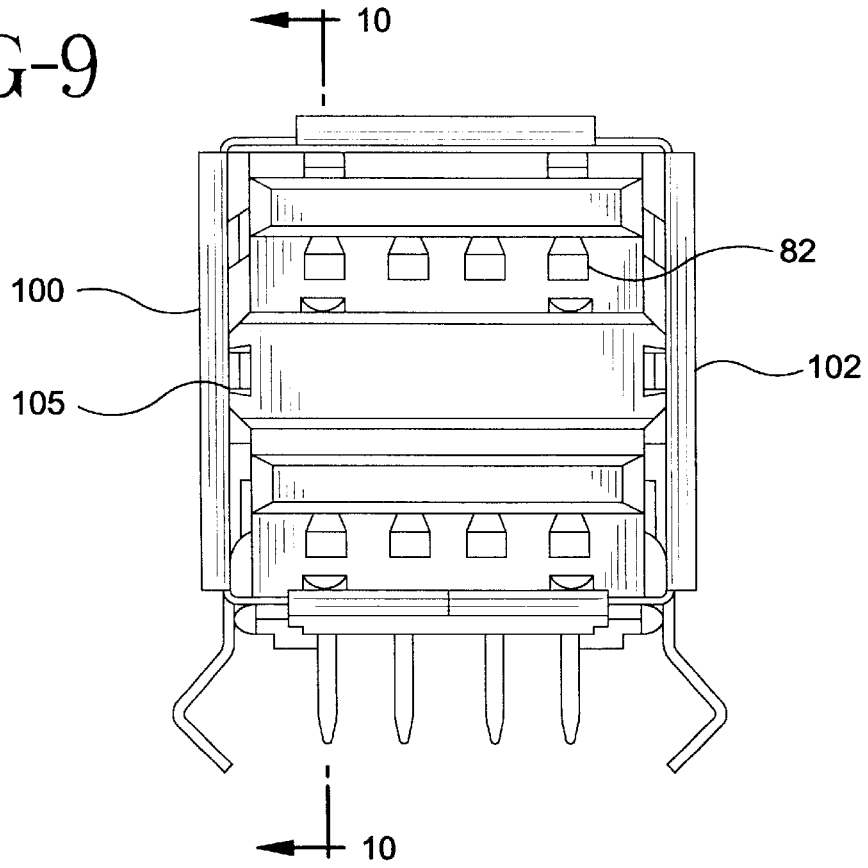
FIG. 9 is a front elevational view of the electrical connector assembly shown in FIG. 8.
Figure 10:
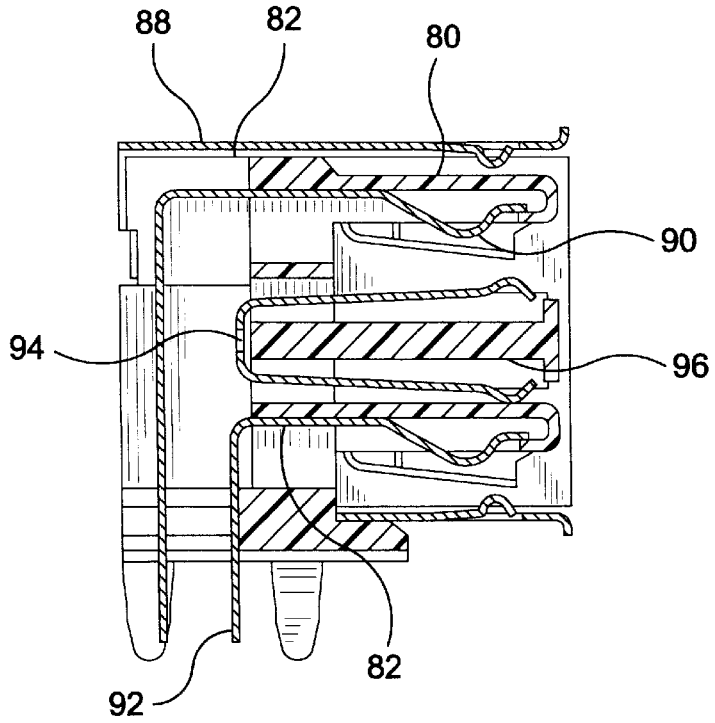
FIG. 10 is a sectional view of the electrical connector assembly taken along line 10—10 of FIG. 9.

Referring to FIG. 10, a cross-sectional view of the connector assembly taken along lines 10—10 of FIG. 9 is illustrated. The contact members 82 include a cantilevered deflectable interconnection portion 90 and a right-angle termination portion 92. The termination portion extends below a bottom surface of the housing 80 and conductive shield 88 for placement within plated through holes of a printed circuit board. The interconnection end of the contact members is deflectably supported by the insulative housing within a guided recess therein. Also shown in FIG. 10 is a further central shield extent 94 which is inserted around a central housing portion 96. The central shield portion 94 is in electrical communication with a portion of the conductive shield for electrical continuity.

Figure 8:
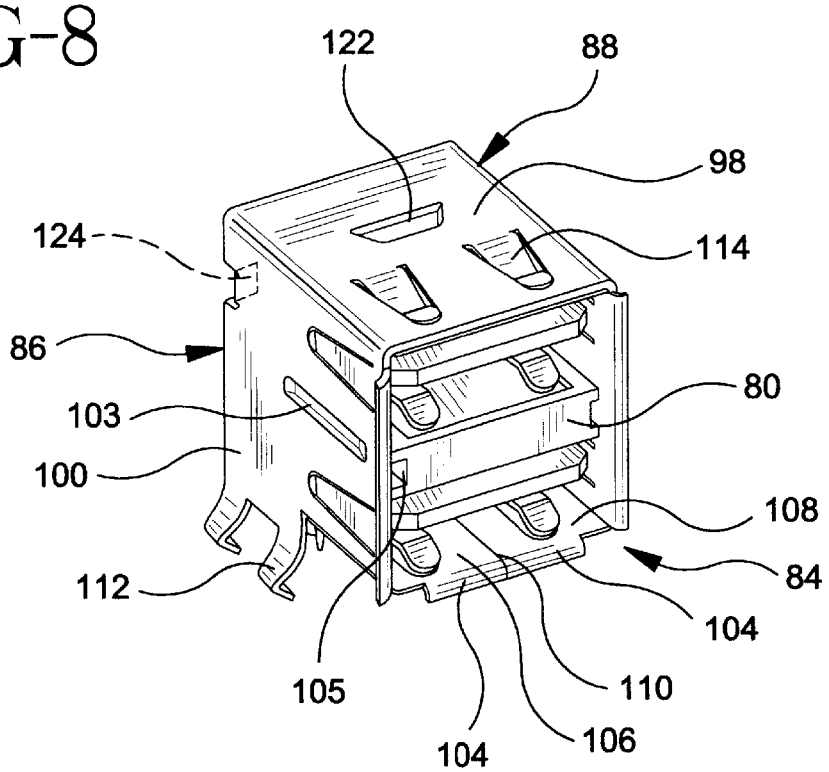
FIG. 8 is a front perspective view of an alternative embodiment of an electrical connector assembly formed in accordance with the present invention.

The conductive shield 88 of the connector assembly shown in FIGS. 8–11 includes an upper shield extent 98, two opposed side shield extents 100, 102 and a bottom shield extent 104. The opposed side shield extents 100, 102 extend downwardly from the upper shield extent 98 and the bottom shield extent 104 includes a pair of bottom shield portions 106, 108 which depend from each of the side shield extents. The bottom shield portions 106, 108 form a longitudinal parting line 110 therebetween when positioned around the housing 80. Each of the side shield extents 100, 102 further includes at least one leg which extends downwardly therefrom for lockingly coupling the electrical connector assembly to a printed circuit board as previously described. As shown in FIG. 8, each of the side shield extents also includes an elongate recessed strip 103 and the housing includes a corresponding recess or slot 105 for guiding alignment of the housing into the conductive shield, during the assembly process for maintaining alignment of the shield and housing after assembly.

The conductive shield 88 further includes a plurality of cantilevered contact members 114 which extend into the bounded compartment formed by the conductive shield. Each of the conductive shield cantilevered contact members 114 electrically engage a portion of a shield located on a mating connector upon interconnection therebetween. Accordingly, electrical continuity between the shield of the plug and the shield of the receptacle is maintained.

Figure 11:
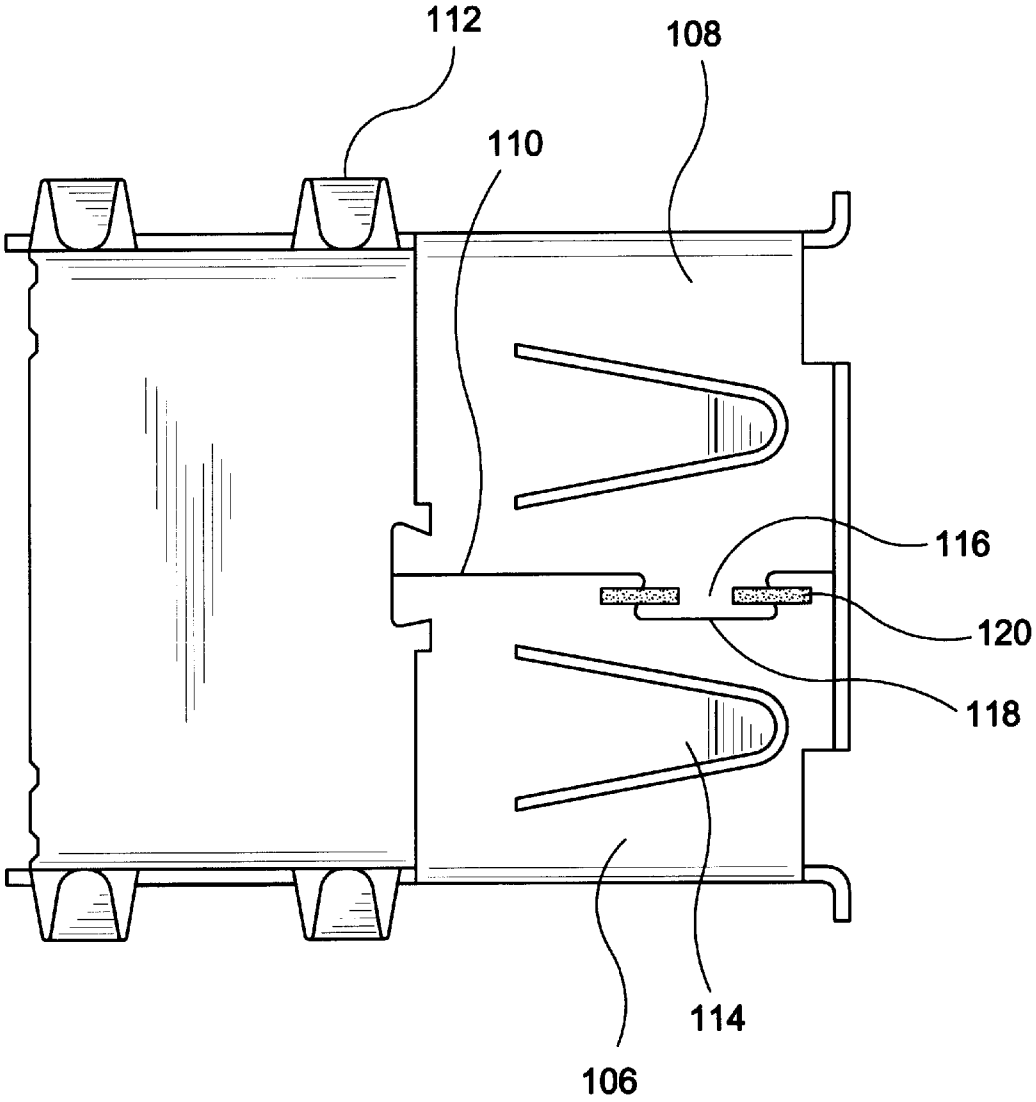
FIG. 11 is a bottom plan view of the conductive shield portion of the electrical connector assembly shown in FIG. 8.

FIG. 11 is a bottom plan view of the shield portion of the electrical connector shown in FIG. 8. More specifically, FIG. 11 illustrates the means for connecting the two bottom shield portions 106, 108 along the longitudinal parting line 110. The connecting means includes a dovetail shaped tab portion 116, i.e., the sides of the tab are divergent, and a corresponding dovetail shaped recess 118 on the other bottom shield portion. Accordingly, after the housing is inserted into the shield, the cooperating interlocking dovetail 116 and mating recess 118 are lockingly coupled together. To further enhance the interlocking dovetail and recess, the bottom shield extent is staked 120 along the parting line in the area of the dovetail and mating recess. After staking along the parting line, the bottom shield portions are positively locked together, preventing separation therebetween.

Referring back to FIG. 8, a second cooperating interlocking engagement means is provided on the upper shield extent for cooperation with an upper housing surface. The upper shield extent 98 includes a projection or inwardly deflected finger portion 122 which locks into a slotted portion in the upper surface of the insulative housing. The slotted housing portion includes a side wall which lockingly engages an end portion of the inwardly deflected cantilevered finger 122. Accordingly, the interlocking engagement means provided on the upper and bottom surfaces of the shield maintain proper positioning of the shield with respect to the insulative housing. Thus, the conductive shield does not lift off the housing during interconnection and disconnection with a mating plug. Furthermore, the conductive shield of the present invention is a one-piece construction and, accordingly, provides better EMI shield protection. The positive latching of the conductive shield to the insulative housing also provides greater alignment of the shield with respect to the housing. To further enhance shield latching, the side shield extents include tabs 124 which are bent around the contact insertion end of the insulative housing to prevent any movement of the shield with respect to the housing.

It will be understood by those of ordinary skill in the art that a configuration similar to that illustrated in FIG. 6 may be employed in the embodiment shown in FIG. 8 to provide a rear shield extent which substantially covers the contact insertion end of the insulative housing. Furthermore, it is to be understood that the conductive shield interlocking means with respect to the housing may be employed in a USB series A single receptacle, i.e., a single row of electrical contacts as opposed to the two rows of vertically stacked contacts in the embodiment shown in FIGS. 8–11.

Although the illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

We claim:

1. An electrical connector assembly, comprising:

an insulative housing having an interconnection end and an opposed contact receiving end, the housing further including an upper surface and a pair of spaced apart side surfaces depending from the upper surface;

at least one contact member supported within said housing, said contact member being insertably positioned in the housing through said contact receiving end; and a one-piece conductive shield being positioned in partial circumscribing relation about said housing, the shield having a pair of side shield extents overlying the side surfaces of the housing, said shield further including an upper shield extent comprising a pair of longitudinally separated shield portions and forming a parting line therebetween, the pair of shield portions together substantially overlying the upper surface of the housing, said side shield extents and housing sidewalls having first cooperating interlocking members for preventing relative movement between said housing and said shield along a longitudinal direction of the housing, each of said upper shield extent shield portions and housing upper surface including second cooperating interlocking members for preventing relative transverse movement of said shield portions along the parting line.

2. An electrical connector assembly as defined in claim 1, wherein said at lease one projection includes a ramped surface for facilitating placement of said shield on said housing.

3. An electrical connector assembly as defined in claim 1, wherein the first cooperating interlocking members comprise at least one projection extending from the side surface of the housing and wherein said shield side extent includes a mating recess for receiving said at least one projection.

4. An electrical connector assembly as defined in claim 1, wherein each of the shield portions include an inwardly deflected cantilevered finger portion and wherein said housing upper surface includes finger engaging members for engagement with said finger portions to lockingly engage said shield to said housing.

5. An electrical connector assembly as defined in claim 4, wherein said finger engaging members include a slot in the upper surface of the housing having upstanding sidewalls, said cantilevered finger portions engaging the sidewalls to lockingly engage said shield to said housing.

6. An electrical connector assembly as defined in claim 1, wherein said shield includes a front face from which the upper shield extend portions and side shield extents extend from and said front face defining an opening permitting access to said interconnection end of said housing.

7. An electrical connector assembly as defined in claim 6, wherein said front face includes a pair of transversely opposed cantilevered shield contacts extending into said interconnection end of said housing for electrical engagement with shield portions of a mating electrical connector upon interconnection therewith.

8. An electrical connector assembly as defined in claim 1, wherein the shield further includes a rear shield extent substantially overlying said termination end of said housing.

9. An electrical connector assembly as defined in claim 1, wherein the shield further includes at least one leg extending downwardly from each of said side shield extents for lockingly engaging said connector to a printed circuit board.

10. An electrical connector assembly as defined in claim 1, wherein the first cooperating interlocking members and second cooperating interlocking members are of different construction.

11. An electrical connector assembly, comprising:

an insulative housing, said housing including an upper surface, two side surfaces depending downwardly from said upper surface, a front interconnection end, an opposed rear end and a bottom surface;

at least one electrical contact supported by said insulative housing, the contact having a connection end supported adjacent the housing interconnection end and a terminating end extending beyond said housing; and a conductive shield being positioned in partial circumscribing relation about said housing, said shield including a front face from which depends at least opposed sidewalls overlying said housing side surfaces and an upper shield extent substantially overlying the housing upper surface and being formed in a pair of longitudinally separated shield portions and forming a parting line therebetween, each of the shield portions and upper surface of said housing including cooperating interlocking members, the cooperating interlocking members comprising inwardly deflected cantilevered fingers on said shield portions and finger engaging members on said upper surface of said housing to lockingly engage said shield portions to said housing and prevent relative transverse movement of said shield portions with respect to each other along the parting line.

12. An electrical connector assembly as defined in claim 11, further comprising locking members associated with each of said shield sidewalls and said housing sidewalls for lockingly engaging said shield sidewalls to said housing sidewalls.

13. An electrical connector assembly as defined in claim 11, wherein said front face defines an opening permitting access to said interconnection end of said housing.

14. An electrical connector assembly as defined in claim 13, wherein said front face includes a pair of transversely opposed cantilevered shield contacts extending into said interconnection end of said housing for electrical engagement with shield portions of a mating electrical connector upon interconnection therewith.

* * * * *